US006001046A

United States Patent [19]

Chang

[11] Patent Number: 6,001,046

[45] Date of Patent: Dec. 14, 1999

[54] COLLAPSIBLE RECUMBENT EXERCISE BICYCLE APPARATUS

[75] Inventor: Sam Chang, Taichung Hsien, Taiwan

[73] Assignee: LifeGear, Inc., Rockaway Township, N.J.

[21] Appl. No.: 09/121,809

[22] Filed: Jul. 23, 1998

[51] Int. Cl.[6] ..... A63B 21/00

[52] U.S. Cl. ..... 482/57; 482/62; 482/72

[58] Field of Search ..... 482/57, 72, 142, 482/908, 95, 96, 51, 62

[56] References Cited

U.S. PATENT DOCUMENTS

| | | | |
|---|---|---|---|
| 4,653,751 | 3/1987 | Green | 272/144 |
| 4,838,547 | 6/1989 | Sterling | 272/134 |
| 5,580,340 | 12/1996 | Yu | 482/96 |
| 5,722,917 | 3/1998 | Olschansky et al. | 482/72 |
| 5,823,917 | 10/1998 | Chen | 482/57 |
| 5,830,114 | 11/1998 | Halfen et al. | 482/70 |

*Primary Examiner*—Jerome W. Donnelly
*Assistant Examiner*—Tam Nguyen
*Attorney, Agent, or Firm*—David L. Davis

[57] ABSTRACT

Collapsible recumbent exercise bicycle apparatus wherein the seat is pivotably coupled to the base and the seat back is pivotably coupled to the seat. The seat and seat back are therefore convertible between an upright user-supporting configuration and a folded storage configuration. Further, the base is telescopically collapsible to reduce the footprint of the apparatus for storage.

9 Claims, 8 Drawing Sheets

COLLAPSIBLE RECUMBENT EXERCISE BICYCLE APPARATUS

BACKGROUND OF THE INVENTION

This invention relates to recumbent exercise bicycle apparatus and, more particularly, to such apparatus which are selectively collapsible from a use configuration to a space saving storage configuration.

Recumbent exercise bicycle apparatus are well known wherein the user is seated at substantially the same level as a pedal mechanism which offers resistance, usually variable, to provide a lower body workout for the user. Typically, an apparatus takes up a significant amount of floor space, which is the same whether the apparatus is in use or is being stored during periods of non-use. When an apparatus is in a personal residence, particularly a small apartment, space is at a premium. It would therefore be desirable to provide an exercise apparatus of the type described which can be configured into a storage mode which minimizes the amount of required floor space.

It would also be desirable that the apparatus be convertible between its use and storage configurations without requiring the use of any tools.

SUMMARY OF THE INVENTION

According to the present invention, the recumbent bicycle seat is mounted to a seat support which in turn is pivotably connected to the apparatus base. The seat back is mounted to a seat back support which in turn is pivotably connected to the seat support. Thus, the seat back and the seat can be pivoted toward each other into a storage configuration. A connector mechanism is provided to lock the seat and the seat back in an upright user-supporting configuration.

In accordance with an aspect of this invention, the apparatus base is telescopically collapsible to further reduce the footprint of the apparatus when it is in its storage configuration.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
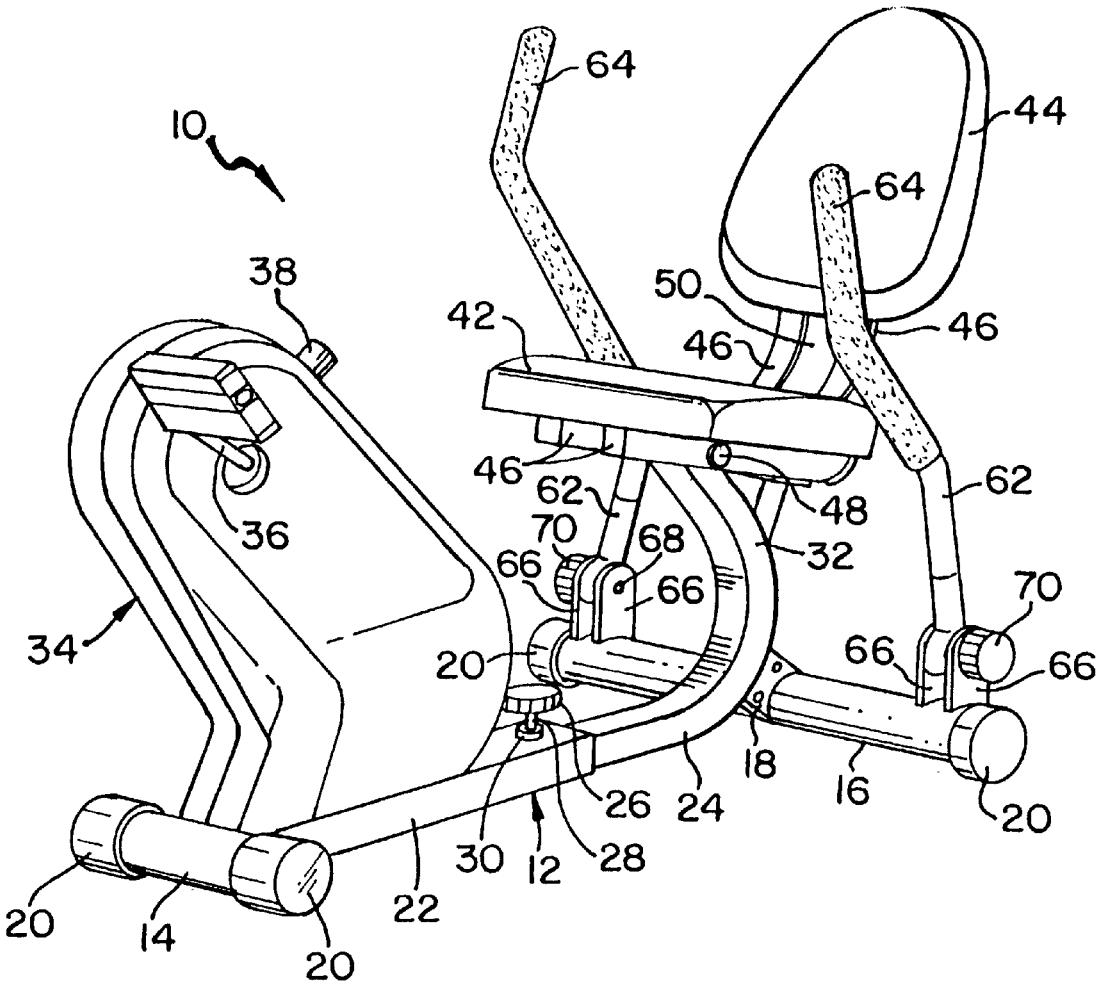
FIG. 1 is a perspective view showing a first embodiment of recumbent exercise bicycle apparatus, constructed according to the present invention, in its use configuration.
Figure 2:
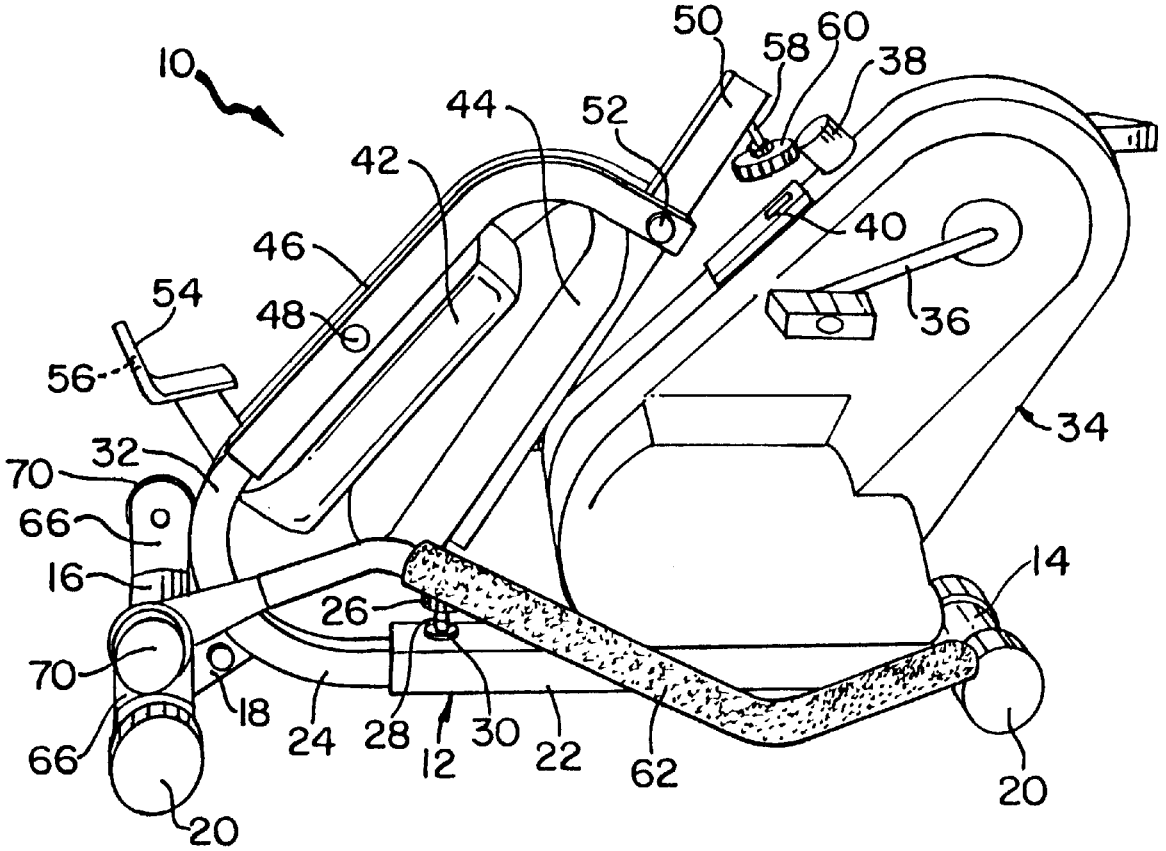
FIG. 2 illustrates the apparatus of FIG. 1 when collapsed into its storage configuration.

Referring now to the drawings, FIG. 1 illustrates a first embodiment of the recumbent exercise bicycle apparatus, designated generally by the reference numeral 10, according to the present invention and configured for use, and FIG. 2 illustrates the same apparatus 10 configured for storage. As shown, the apparatus 10 includes a base 12, a first stabilizer bar 14 and a second stabilizer bar 16. The stabilizer bars 14, 16 are parallel to each other and are secured to the base 12, as by brackets 18 and welding, or the like, at spaced locations on the base 12. The stabilizer bars 14, 16 are adapted to be supported on a floor and are terminated by friction-providing caps 20.

The base 12 includes a first base member 22 which is secured to the first stabilizer bar 14 and a second base member 24 which is secured to the second stabilizer bar 16. Each of the first and second base members 22, 24 has a respective straight tubular section, with the straight tubular section of the second base member 24 being telescopically received within the straight tubular section of the first base member 22. Thus, the distance between the stabilizer bars 14, 16 can be selectively varied. A knob 26 secured to a threaded rod 28 is provided for use as a lock. The rod 28 is received within a nut 30 secured, as by welding, to the base member 22 in alignment with an opening (not shown) in the base member 22. Thus, the knob 26 can be rotated to extend the rod 28 into the base member 22 to engage the base member 24 for a desired spacing between the stabilizer bars 14, 16. The base 12 further includes an extension 32 which extends from the base member 24 where it is secured to the stabilizer bar 16, upwardly and toward the stabilizer bar 14. Preferably, the extension 32 and the base member 24 are formed unitarily from a single length of tubing material.

A pedal mechanism 34, preferably encased within a shroud, is secured to the base member 22 adjacent the stabilizer bar 14 and extends upwardly from the base member 22. As is conventional, the pedal mechanism 34 includes a pair of cranks 36 coupled to an internal flywheel (not shown) arranged to provide resistance to rotation. The amount of resistance may be adjusted by a knob 38 mounted to the shroud and connected by an internal cable (not shown) to a resistance providing friction belt (not shown) wrapped around the flywheel. In addition, a display 40 may be provided to advise the user of elapsed time, speed, calories expended, etc.

The apparatus 10 further includes a cushioned seat 42 and a cushioned seat back 44. The seat 42 is mounted to a seat support 46, illustratively a pair of parallel spaced apart tubular members, each having a straight section under the seat 42 and an upwardly extending section to the rear of the seat 42. The seat supports 46 flank the base extension 32 and are pivotally connected thereto by a pivot pin 48 defining a first pivot axis parallel to the stabilizer bars 14, 16. The seat back 44 is mounted to a seat back support 50 which is preferably a straight tubular piece positioned between the seat supports 46 and connected to the upwardly extending portion of the seat supports 46 by a pivot pin 52 defining a second pivot axis parallel to the stabilizer bars 14, 16.

To secure the seat 42 and seat back 44 in an upright user-supporting configuration, a bracket 54 is mounted to the base extension 32, as by welding or the like. The bracket 54 is generally L-shaped and has an internally threaded opening 56 in its upwardly extending portion. For cooperating with the bracket 54, a threaded rod 58 terminated by a knob 60 is journalled for rotation to the seat back support 50. When the seat 42 and the seat back 44 are in the upright user-supporting configuration, the rod 58 is aligned with the opening 56 and may be threadedly secured therein for locking the seat 42 and seat back 44 in that configuration.

The apparatus 10 further includes a pair of poles 62 positioned across the seat 42 from each other. Each of the poles 62 includes a hand grip 64 at an upper end, preferably covered by cushioning material. At the other end, each of the poles 62 is pivotably connected to the stabilizer bar 16. As shown, this pivotable connection is provided by a pair of upstanding brackets 66 secured to the stabilizer bar 16 and a pivot pin 68 terminated by a knob 70 extending through the outer one of the brackets 66, the pole 62, and the other of the brackets 66. The pivot pins 68 and the brackets 66 are adapted so that the knobs 70 can be rotated to selectively increase or decrease the friction between the brackets 66 and the poles 62, to either lock the poles 62 in position, release the poles 62, or provide a selected amount of resistance to pivoting of the poles 62. Thus, if desired, the poles 62 can be used to allow the user to have an upper body workout, in addition to the lower body workout provided by the pedal mechanism 34. Alternatively, the poles 62 can be locked to act as stabilizers for the user.

Figure 3:
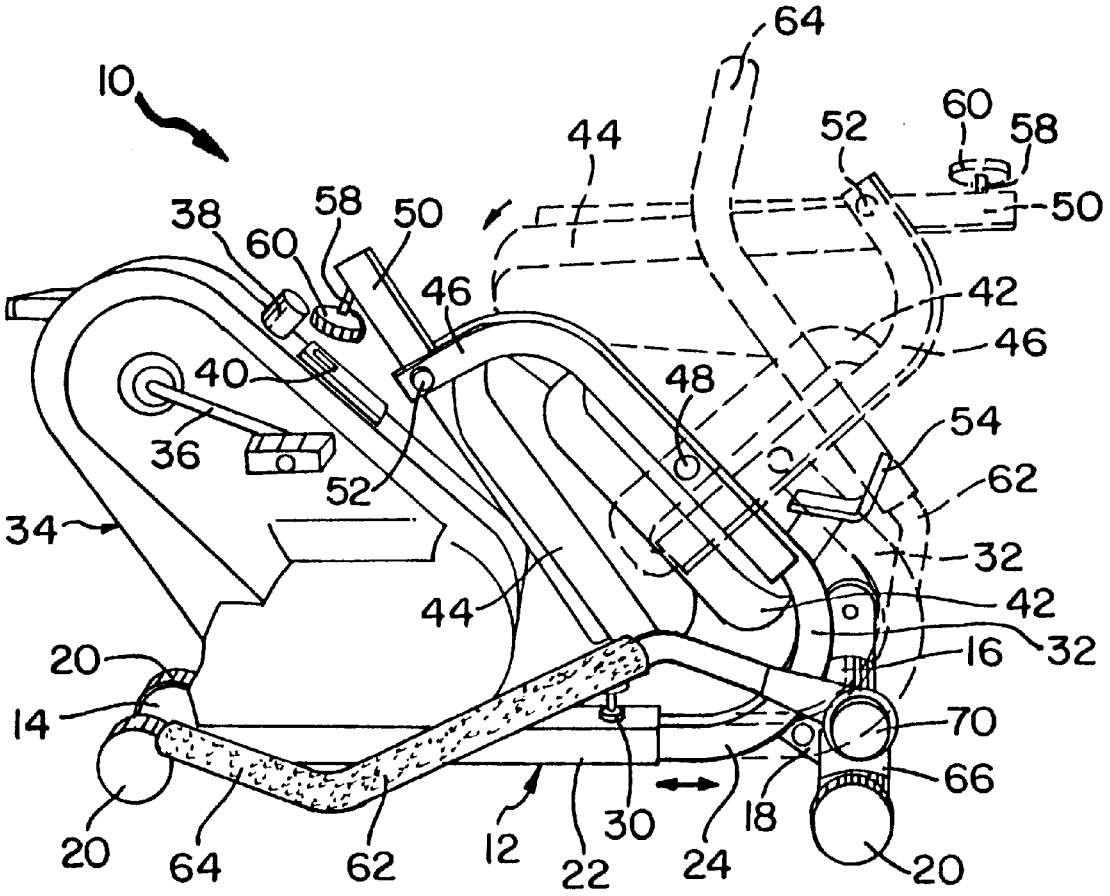
FIG. 3 illustrates the apparatus of FIGS. 1 and 2 being converted between its use and storage configurations.
Figure 4:
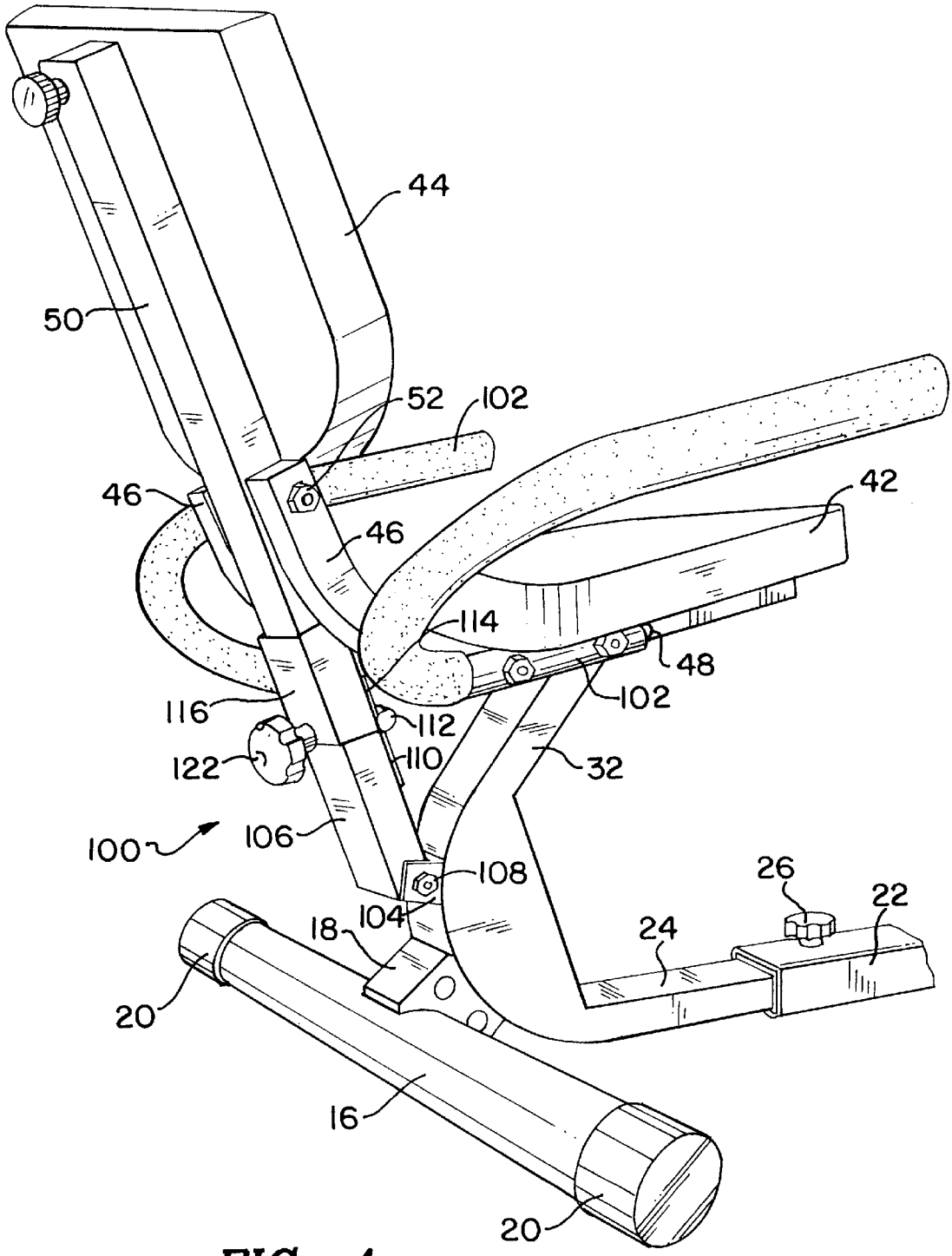
FIG. 4 is a perspective view showing a portion of a second embodiment of recumbent exercise bicycle apparatus, constructed according to the present invention, in its use configuration, wherein the pedal mechanism portion of the apparatus which is the same as that shown in FIGS. 1–3 has been omitted.
Figure 5:
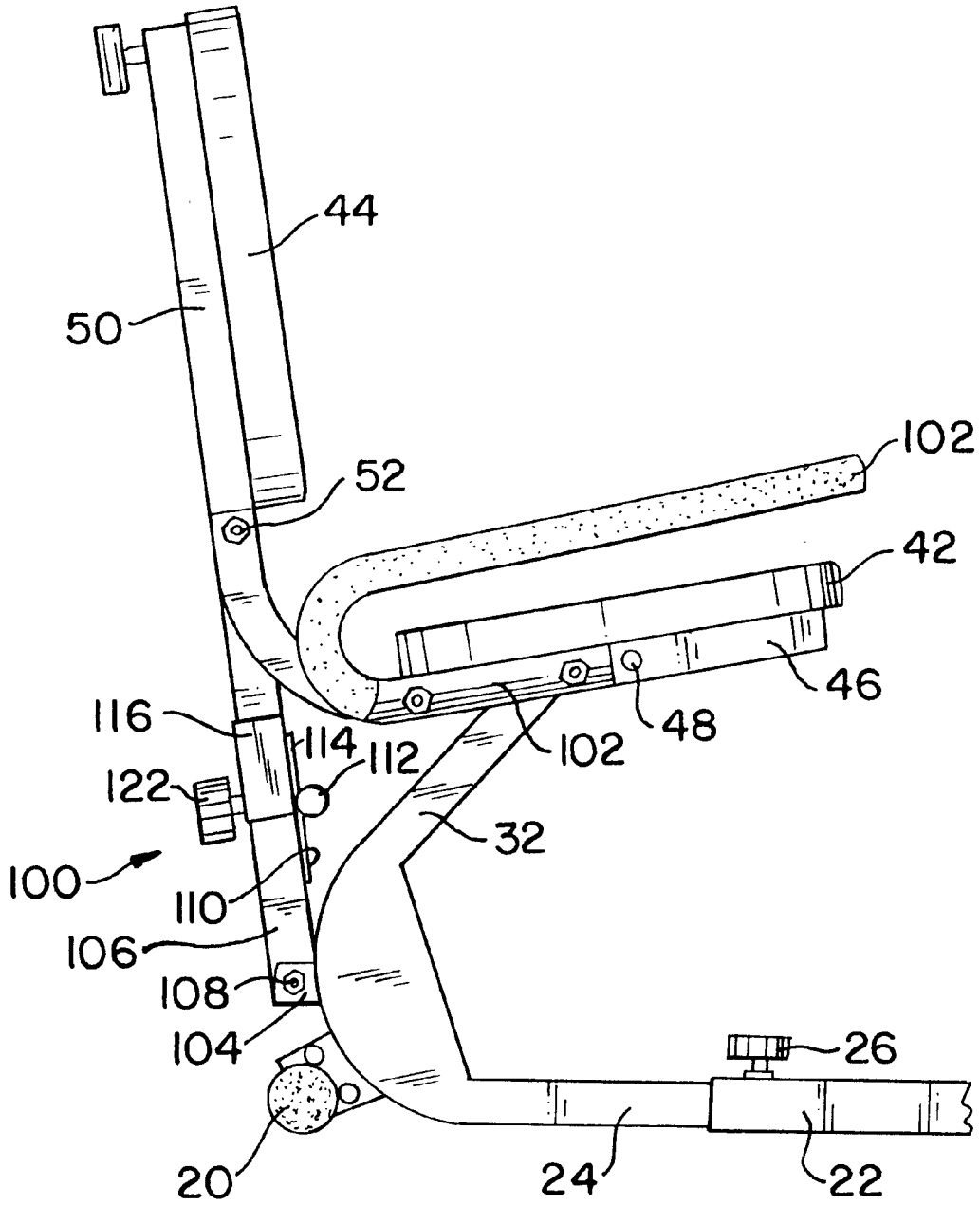
FIG. 5 is a side view of the apparatus shown in FIG. 4.

To place the apparatus 10 in its space-saving storage configuration, the knob 60 is turned counterclockwise to remove the threaded rod 58 from the threaded opening 56 in the bracket 54. The seat back 44 and the seat 42 are then folded forwardly, as shown by the broken lines in FIG. 3, and then folded fully forwardly, as shown by the solid lines in FIG. 3. It is noted that in this fully folded configuration, the seat back support 50 is almost parallel to the slanted side of the housing of the pedal mechanism 34. The knob 26 is then rotated counterclockwise to unclamp the base member 24. The base member 24 is then collapsed into the base member 22, thereby reducing the footprint of the apparatus 10. The knob 26 may then be rotated clockwise to maintain that reduced footprint. The knobs 70 are then rotated counterclockwise and the poles 62 are pivoted downwardly. The knobs 70 may then be rotated clockwise to maintain the poles 62 in that position. To open up the apparatus 10 for use, the foregoing steps are reversed.

FIGS. 4–9 illustrate the folding seat portion of a second embodiment of recumbent exercise bicycle apparatus, designated generally by the reference numeral 100, according to the present invention, the pedal mechanism end of the apparatus 100 being the same as the pedal mechanism portion of the apparatus 10 (FIGS. 1–3) and being omitted from FIGS. 4–9. As shown, the apparatus 100 includes a cushioned seat 42 and a cushioned seat back 44. The seat 42 is mounted to a seat support 46, illustratively a pair of parallel spaced apart tubular members, each having a straight section under the seat 42 and an upwardly extending section to the rear of the seat 42. The seat supports 46 flank the base extension 32 and are pivotally connected thereto by a pivot pin 48 defining a first pivot axis parallel to the stabilizer bars 14, 16. The seat back 44 is mounted to a seat back support 50 which is preferably a straight tubular piece positioned between the seat supports 46 and connected to the upwardly extending portion of the seat supports 46 by a pivot pin 52 defining a second pivot axis parallel to the stabilizer bars 14, 16. A pair of handles 102, preferably being covered by cushioning material at their free ends, are fixedly secured each to one of the seat supports 46 so as to flank the seat 42. The fixed handles 102 are an alternative to the poles 62 (FIGS. 1–3), and it is understood that either the movable poles 62 or the fixed handles 102 can be installed on the apparatus 10 and 100, as desired.

A U-shaped bracket 104 is secured to the base extension 32, as by welding or the like. A connecting bar 106 has its first end pivotably connected to the base extension 32 about a third pivot axis defined by the pivot pin 108 extending through the connecting bar 106 and the bracket 104, which flanks the connecting bar 106. Like the first and second pivot axes, the third pivot axis is parallel to the stabilizer bars 14, 16. The other end of the connecting bar 106 has secured thereto, as by welding or the like, a hinge plate 110 of a hinge assembly including a hinge pin 112, which defines a fourth pivot axis parallel to the stabilizer bars 14, 16. The hinge assembly further includes a hinge plate 114 which is secured, as by welding or the like, to the lower end of the seat back support 50. Thus, the seat back support 50 and the connecting bar 106 are pivotably connected one to the other about the fourth pivot axis defined by the hinge pin 112.

Figure 9:
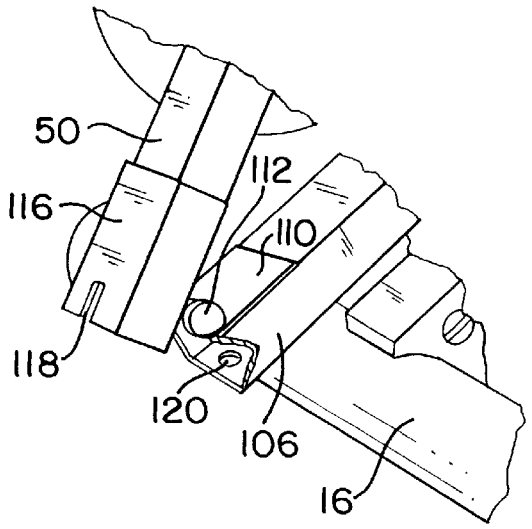
FIG. 9 is an enlarged perspective view of a portion of the apparatus shown in FIG. 4 showing details of the connector mechanism for locking the seat and seat back in an upright user-supporting configuration.

To lock the seat 42 and the seat back 44 in an upright user-supporting configuration, there is provided a bracket member 116 which is secured, as by welding or the like, to the lower end of the seat back support 50 opposite the hinge plate 114. Illustratively, the bracket member 116 is three-sided. In any event, the bracket member 116 extends beyond the lower end of the seat back support 50 so as to overlie the upper end of the connecting bar 106 opposite the hinge plate 110. As best shown in FIG. 9, the lower end of the bracket member 116 is formed with an opening, illustratively a slot 118, and the upper end of the connecting bar 116 is formed with an internally threaded aperture 120. The slot 118 and the aperture 120 are positioned so that when the seat 42 and the seat back 44 are in the upright user-supporting configuration, the slot 118 is aligned with the aperture 120. Accordingly, a knob 122 having a threaded rod 124 secured thereto is provided. The rod 124 is inserted through the slot 118 and is threadedly received in the aperture 120 for locking the apparatus 100 in its user-supporting configuration.

Figure 6:
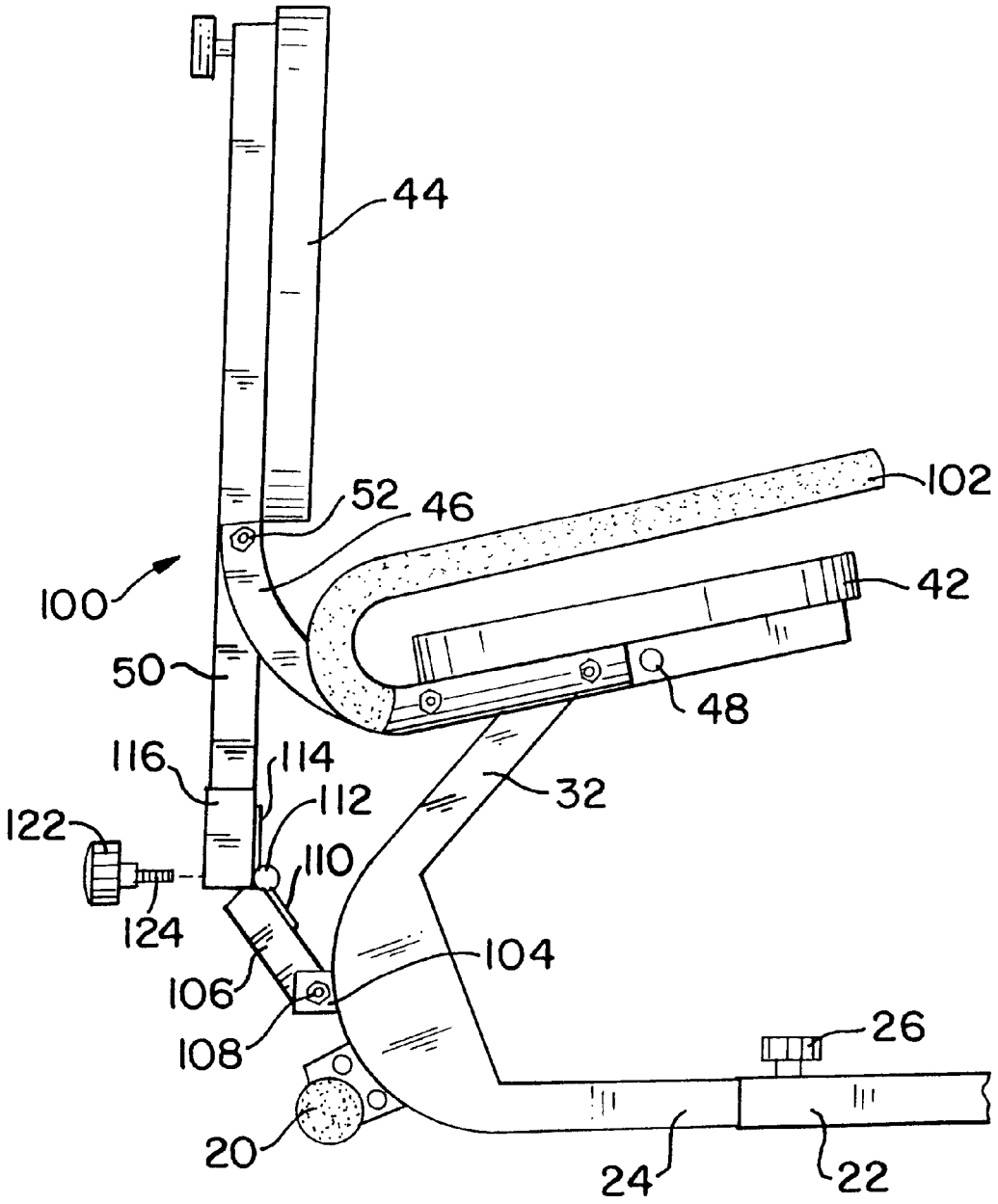
FIGS. 6–8 are side views showing different stages of the conversion of the apparatus shown in FIG. 4 from its use configuration shown in FIG. 5 to its storage configuration shown in FIG. 8.
Figure 7:
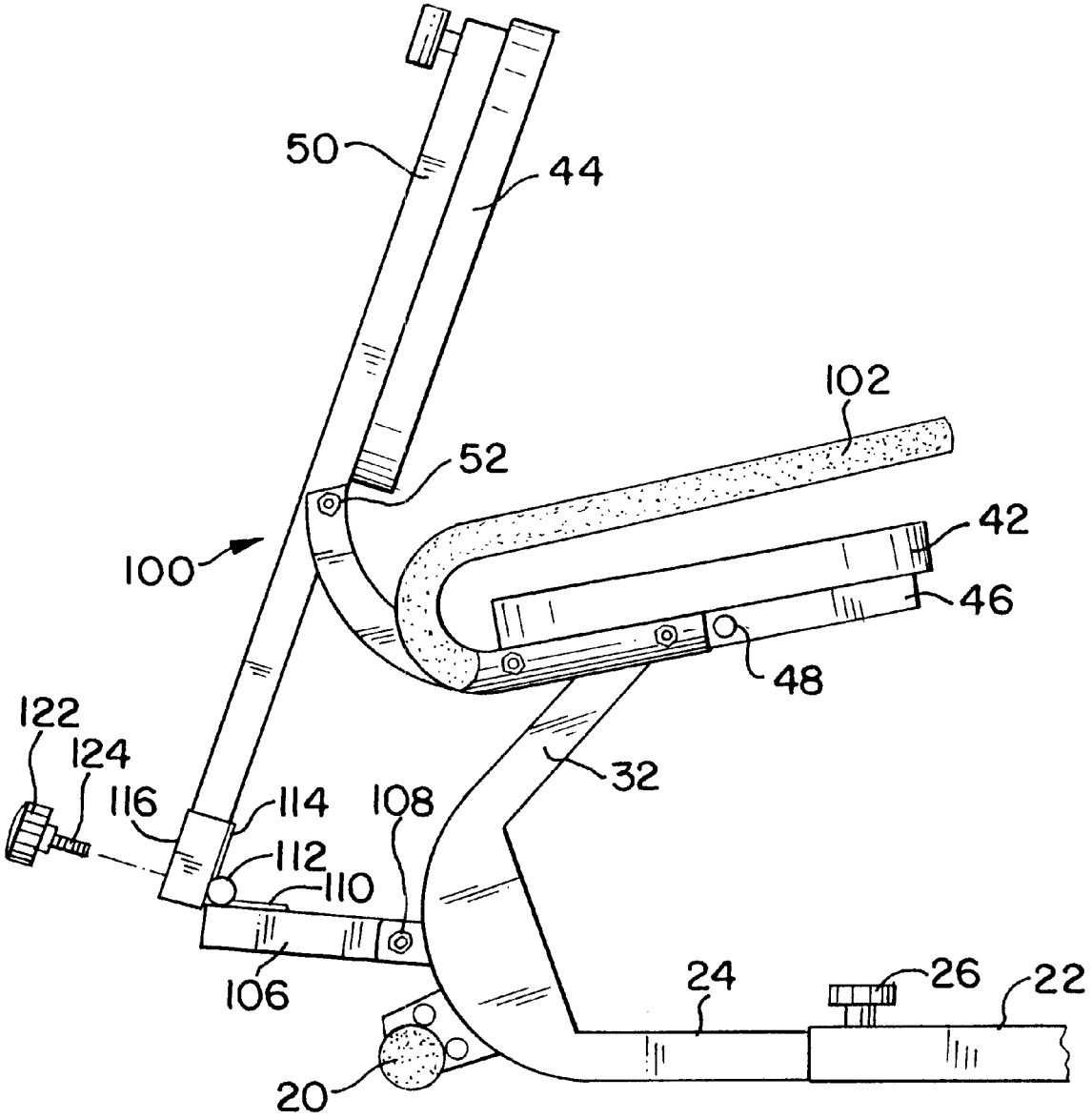
Figure 8:
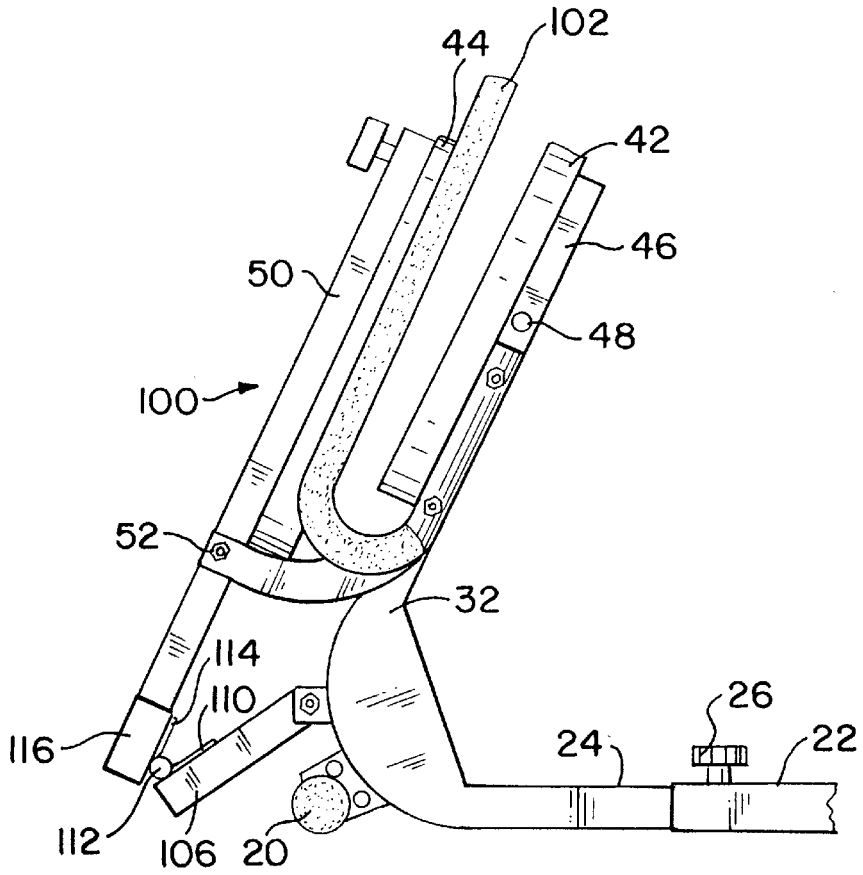

To convert the apparatus 100 from its user-supporting configuration to its folded space-saving storage configuration, the knob 122 is turned counterclockwise to remove the threaded rod 124 from the aperture 120. As shown in FIG. 6, this allows the connecting bar 106 and the seat back support 50 to pivot about the hinge pin 112, the connecting bar 106 to pivot about the pivot pin 108, the seat back support 50 and the seat supports 46 to pivot about the pivot pin 52 and the seat supports 46 to pivot about the pivot pin 48. Further pivoting of these elements is shown in FIG. 7, with the final folded storage configuration being shown in FIG. 8.

As illustrated, the bracket member 116 is formed with a slot 118. Alternatively, an enclosed aperture could replace the slot 118, in which case the aperture would be aligned with the aperture 120 when the apparatus 100 is in its upright user-supporting configuration. The use of the slot 118 allows the knob 122/threaded rod 124 to be merely loosened without total removal from the aperture 120 when the apparatus 100 is reconfigured.

Although the apparatus 100 has been shown with the bracket member 116 extension opposite the hinge assembly, it is understood that similar results are attained with lateral alignment of the elements.

Accordingly, there has been described an improved collapsible recumbent exercise bicycle apparatus. While illustrative embodiments of this invention have been disclosed herein, it is understood that various modifications and adaptations to the disclosed embodiments are possible, and it is intended that this invention be limited only by the scope of the appended claims.

What is claimed is:

1. Recumbent exercise bicycle apparatus comprising:

a base;

first and second stabilizer bars secured to said base at spaced locations on said base, said first and second stabilizer bars being parallel each to the other and adapted to be supported on a floor to stabilize said base;

a pedal mechanism secured to said base adjacent said first stabilizer bar and extending upwardly from said base;

a base extension extending from said base adjacent said second stabilizer bar upwardly and toward said first stabilizer bar;

a seat support pivotably connected to said base extension about a first pivot axis parallel to said first and second stabilizer bars;

a seat mounted to said seat support;

a seat back support pivotably connected to said seat support about a second pivot axis parallel to said first pivot axis;

a seat back mounted to said seat back support; and a connector mechanism having a first part mounted to said seat back support and a second part mounted to said base extension, said first and second parts being engageable one part with the other to lock said seat and said seat back in an upright user-supporting configuration.

2. The apparatus according to claim 1 wherein said connector mechanism comprises:

a threaded rod supported by one of said seat back support and said base extension for rotation about the longitudinal axis of said rod; and a bracket secured to the other of said seat back support and said base extension, said bracket having an internally threaded opening for accepting said threaded rod.

3. The apparatus according to claim 1 wherein said base comprises:

a first base member secured to said first stabilizer bar; and a second base member secured to said second stabilizer bar;

wherein said first and second base members each includes a respective straight tubular section, one of said straight tubular sections adapted to be telescopically received in the other of said straight tubular sections so that the distance between said seat and said pedal mechanism can be selectively varied by the user.

4. The apparatus according to claim 3 further comprising:

a lock selectively engageable between said straight tubular sections to secure said straight tubular sections one to the other.

5. The apparatus according to claim 1 further comprising:

a pair of poles positioned across said seat from each other, each of said poles having a hand grip at one of its ends and being pivotably mounted to said second stabilizer bar at the other of its ends.

6. The apparatus according to claim 5 further comprising:

means associated with each of said poles for providing resistance to pivoting of the respective pole.

7. The apparatus according to claim 1 wherein said connector mechanism comprises:

a connecting bar having a first end pivotably connected to said base extension about a third pivot axis parallel to said first and second pivot axes and a second end pivotably connected to said seat back support about a fourth pivot axis parallel to said third pivot axis; and a bracket member secured to said seat back support and having an extension overlying said connecting bar when said seat and said seat back are in said upright user-supporting configuration;

wherein said connecting bar has an internally threaded aperture positioned to underlie said bracket member extension and said bracket member extension has an opening positioned in alignment with said connecting bar aperture when said seat and said seat back are in said upright user-supporting configuration; and said connector mechanism further includes a knob with a threaded rod secured thereto and adapted to extend through said bracket member extension opening and be threadedly received in said connecting bar aperture to lock said seat and said seat back in said upright user-supporting configuration.

8. The apparatus according to claim 7 further comprising:

a hinge having a hinge pin and a pair of hinge plates, wherein a first of said hinge plates is secured to said connecting bar and a second of said hinge plates is secured to said seat back support so that said fourth pivot axis is defined by said hinge pin.

9. The apparatus according to claim 8 wherein said bracket member extension overlies said connecting bar opposite said first hinge plate.

* * * * *